US010633803B2

(12) United States Patent
Højland et al.

(10) Patent No.: US 10,633,803 B2
(45) Date of Patent: Apr. 28, 2020

(54) CORRECTION UNIT

(71) Applicant: TF-TECHNOLOGIES A/S, Fredensborg (DK)

(72) Inventors: John Christian Højland, Valby (DK); Lars Boss Henrichsen, Copenhagen S (DK); Søren Kristiansen, Søborg (DK)

(73) Assignee: TF-TECHNOLOGIES A/S, Fredensborg (DK)

( * ) Notice: Subject to any disclaimer, the term of this patent is extended or adjusted under 35 U.S.C. 154(b) by 0 days.

(21) Appl. No.: 15/737,968

(22) PCT Filed: Jun. 20, 2016

(86) PCT No.: PCT/EP2016/064139

§ 371 (c)(1),
(2) Date: Dec. 19, 2017

(87) PCT Pub. No.: WO2016/203037

PCT Pub. Date: Dec. 22, 2016

(65) Prior Publication Data

US 2018/0237999 A1 Aug. 23, 2018

(30) Foreign Application Priority Data

Jun. 19, 2015 (EP) ..... 15172914

(51) Int. Cl.
*E01C 19/00* (2006.01)
*E01C 19/48* (2006.01)

(52) U.S. Cl.
CPC ..... *E01C 19/006* (2013.01); *E01C 19/004* (2013.01); *E01C 19/4873* (2013.01); *E01C 2301/20* (2013.01)

(58) Field of Classification Search
CPC .. E01C 19/004; E01C 19/006; E01C 19/4873; E01C 2301/20
USPC ..... 404/75, 118, 84.05–84.5
See application file for complete search history.

(56) References Cited

U.S. PATENT DOCUMENTS 5,484,227 A * 1/1996 Ikeda ..... E01C 19/006 404/118
9,045,871 B2 * 6/2015 Graham ..... E01C 19/4873
9,255,364 B2 * 2/2016 Ichikawa ..... E01C 19/48
(Continued)

FOREIGN PATENT DOCUMENTS

EP 0620319 A1 10/1994
EP 1990472 A1 11/2008
(Continued)

*Primary Examiner* — Raymond W Addie
(74) *Attorney, Agent, or Firm* — Bryan Cave Leighton Paisner LLP

(57) ABSTRACT

A correction unit (13) for correcting the position of a side plate (2,2') of a screed (4) of a road paving machine (1) for constructing a road pavement relative to a line (12) on an underlying surface on which the road paving machine (1) is adapted to move, the correction unit (13) comprising a sensor device, where the sensor device is adapted to sense at least part of said underlying surface comprising the line (12) and identify a displacement of the side plate (2,2') of the screed (4) of the road paving machine (1) relative to the line (12) on the underlying surface and provide a sensing signal for controlling the position of the side plate (2,2').

16 Claims, 4 Drawing Sheets

(56) References Cited

U.S. PATENT DOCUMENTS

Figure 1A:
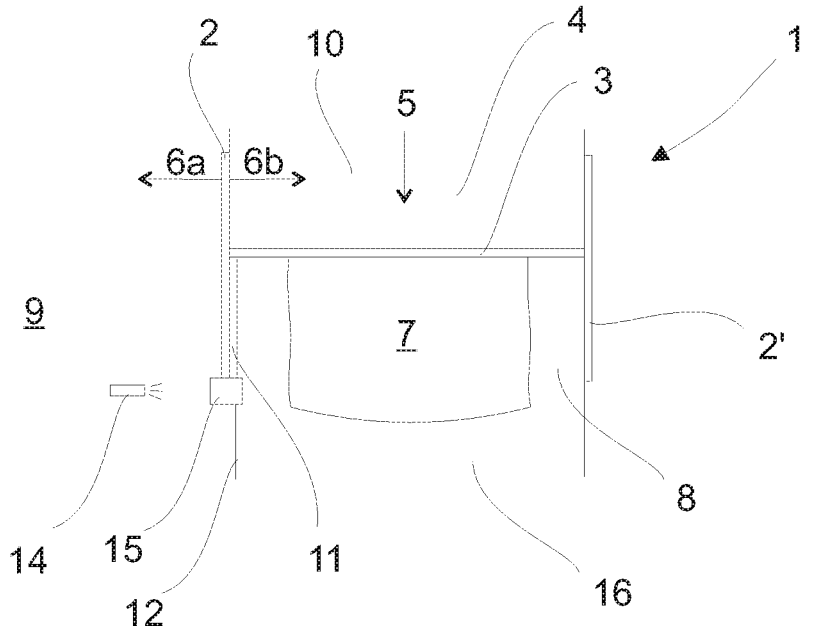

| | | | | |
|---|---|---|---|---|
| 2006/0070193 | A1* | 4/2006 | Hutton | B64F 1/305 14/71.5 |
| 2007/0285537 | A1* | 12/2007 | Dwinell | G06T 7/001 348/263 |
| 2008/0038059 | A1* | 2/2008 | Frelich | E01C 19/48 404/75 |
| 2013/0051913 | A1* | 2/2013 | Eul | E01C 19/006 404/84.5 |
| 2014/0363230 | A1* | 12/2014 | Buschmann | E01C 19/42 404/72 |
| 2015/0199576 | A1* | 7/2015 | Ichikawa | E01C 19/48 382/104 |
| 2016/0060820 | A1* | 3/2016 | Berning | E01C 19/004 404/75 |
| 2016/0261848 | A1* | 9/2016 | Sekiguchi | B60R 1/00 |
| 2017/0118925 | A1* | 5/2017 | Noguchi | G06Q 50/02 |
| 2017/0140227 | A1* | 5/2017 | Takemura | G08G 1/16 |

FOREIGN PATENT DOCUMENTS

| | | | |
|---|---|---|---|
| EP | 2415934 | A1 | 2/2012 |
| EP | 2562309 | A1 | 2/2013 |
| JP | S6197713 | A1 | 5/1986 |

* cited by examiner

CORRECTION UNIT

The present invention relates to a correction unit for correcting the position of a side plate of a screed of a road paving machine for constructing a road pavement relative to a line on an underlying surface on which the road paving machine is adapted to move, the correction unit comprising a sensor device.

The present invention further relates to a screed and a road paving machine comprising the correction unit.

When constructing or re-constructing a stretch of road, a new road pavement may have to be constructed. The new road pavement may comprise two or more strips of road pavement which are aligned next to each other. So as to ensure that the two or more strips of road pavement together form a uniform road pavement, the adjacently lying strips may overlap. However, the overlap may be difficult to control. A too large overlap may result in the formation of a rim being formed along the overlap due to an excess of road pavement material, whereas a too little overlap may result in the density of the road pavement at the overlap being so low that there is a risk that the road pavement may break and/or drop in height due to the stress of the vehicles passing it, or due to an introduction of water into the overlap which may lead to the road pavement breaking during freezing weather conditions. Thus, manpower has to be designated to control that the best possible overlap is created, which may be very difficult to ensure, and which reduces the amount of further responsibilities that the operator can manage.

EP0620319A1 discloses a device for controlling the extension or contraction of a plurality of screeds in an asphalt finisher. The device comprises a detection device recording an illuminated line generated by irradiating the fixed objects along a reference line. The device performs corrections according to the input from the detection devices.

JPS6197713A discloses an asphalt finisher comprising a position detector for detecting the position of said asphalt finisher based on a running reference line put on the surface of a road. Based on the detection of the reference line, the directions of the steering wheels on the asphalt finisher can be changed.

EP1990472A1 discloses a mobile fabrication machine comprising a sensor component and an evaluation component. The sensor component carries out continuous sensing of a part of the underlying surface and from the recordings, the evaluation component determines the relative direction of movement of a reference point of the fabrication machine and derives steering correction information therefrom.

EP2562309A1 discloses a road paver comprising a measuring device capable of obtaining a spatial depiction of the surface using a point cloud. Said spatial depiction is used to convert the point cloud into a levelling signal thereby providing control of the movement of the screed. The measuring device comprises a plurality of laser sensors, and said measuring device is arranged movably.

In accordance with the invention, there is provided a correction unit for correcting the position of a side plate of a screed of a road paving machine for constructing a road pavement relative to a line on an underlying surface on which the road paving machine is adapted to move, the correction unit comprising a sensor device, where the sensor device is adapted to sense at least part of said underlying surface comprising the line and therefrom identify a displacement of the side plate of the screed of the road paving machine relative to the line on the underlying surface and provide a sensing signal for controlling the position of the side plate.

Within the concept of the present invention, the term line may be understood as anything identifying a direction along which a new strip of road pavement is to be constructed. The line may comprise any part of the edge of an existing strip of road pavement or of a foundation on or along which the new strip of road pavement is to be constructed, or of a curb. The line may also be a wire along which a new strip of road pavement is to be constructed, or a wire identifying an edge along which the new strip of road pavement is to be constructed, where the wire may be arranged directly above or next to said edge.

In an embodiment, the line can identify an edge of an existing road pavement of the underlying surface.

Within the concept of the present invention, the term road paving machine is to be understood as comprising a towing machine being responsible for moving forward and steering the road paving machine, and a screed being responsible for directing pavement material towards the underlying surface on which the road paving machine is moving and arranging the pavement material on said underlying surface.

When constructing or re-constructing a road pavement, a new strip of road pavement may be aligned along an existing strip of road pavement, where the two adjacent road pavements are overlapping so as to form a uniform road pavement. However, a too large overlap may result in the formation of a rim being formed along the overlap due to an excess of road pavement material. Having too little overlap may result in the density of the road pavement at the overlap being so low that there is a risk that the road pavement may break and/or drop in height due to the stress of the vehicles passing it, or due to an introduction of water into the overlap which may lead to the road pavement breaking during freezing weather conditions. However, the overlap may be difficult to control.

Providing a correction unit for controlling the overlap of two adjacent strips of road pavement may lead to the quality of the overlap being more easily kept high, so that the above-mentioned risks of creation of a rim or a breakage/drop in height due to an excessive or too low amount of road pavement, respectively, are present at the overlap. Without the use of a correction unit there may also be an alteration between too much and too little road pavement at the overlap.

Having the correction unit provide a sensing signal for controlling the position of the side plate, a road paving machine provides a fast and easy way of achieving and maintaining the correct overlap as only the side plate has to be adjusted relative to the basis part of the screed and not the driving direction of the towing machine of the road paving machine.

Within the concept of the present invention, the term basis part of screed is to be understood as the part of the screed being steadily connected to the towing machine of the road paving machine, whereas the term side plate of the screed being understood as being the outer plates defining the width of the screed and limiting the lateral spreading of the pavement material when directing the pavement material towards the underlying surface. The side plates are understood as being movable in lateral direction relative to the basis part of the screed.

Furthermore, making use of a correction unit to correct the position of the side plates of a road paving machine provides a higher degree of precision in placing a new strip of road pavement along an already existing strip of road pavement according to a predefined value of overlap. This is due to the fact that the correction unit may control the position of a side plate of a screed relative to a line on the underlying surface with use of a sensor device and thus does not have to rely on e.g. an operator having to observe the position of the side plate relative to the line. The position of the side plate of the screed may be controlled continuously or with a predefined time interval. Furthermore, by performing the correction by moving the side plates relative to the basis part of the screed instead of e.g. changing the driving direction of the road paving machine, the correction will be much more precise as only the side plates have to be moved and not the entire road paving machine.

The sensor device may as such be based on, but not limited to, mechanics, ultrasound, optics, or radar.

In an embodiment, said edge of the existing road pavement can be defined by an upper part of a slope/contour between the existing road pavement and the underlying surface.

In an embodiment, said sensor device can produce an image of said edge of the existing road pavement. The image may be an optical image produced by a 2D or a 3D camera which is a reliable and low-cost way of sensing at least part of the underlying surface comprising the edge.

In an embodiment, the correction unit can further comprise a control unit adapted to receive the sensing signal from the sensor device and to adjust the position of the side plate of the screed of the road paving machine relative to the line based on the sensing signal for controlling the position of the side plate.

Providing a sensor device for sensing the position of the side plate of the screed of a road paving machine relative to a line on the underlying surface and a control unit for adjusting the position of said side plate results in automation of the correction process and thus frees the operator from having to make the control himself, which means that the operator may use the freed responsibility on controlling another part of the process of constructing a road pavement which in total will increase the quality of the process of constructing a road pavement.

Thus, the present invention provides a higher quality and precision in constructing a road pavement.

In an embodiment, the sensor device can comprise a detecting unit.

In an embodiment, the detecting unit can comprise at least one optical part.

A detecting unit may detect radiation, such as light, reflected from or emitted from the underlying surface providing information of the surface structure of the underlying surface. Thus, a detecting unit may be used to derive a characterisation of the surface structure, such as by the variation in the intensity of the detected radiation. The detecting unit may be a regular optical camera giving a 2D image of the surface structure, or the detecting unit may be a 3D camera, such as a stereo camera, giving a 3D image of the surface structure which may be analysed to identify the position of the side plate of the screed relative to the line. However, the detecting unit may also be based on mechanics and may as such be a sensor, such as an arm, touching the underlying surface and identifying the location of the line, e.g. based on, but not limited to, the degree of bending of the arm. The detecting unit may e.g. be an optical camera.

A detecting unit in the form of a 3D camera, such as a stereo camera or a range camera, may advantageously provide the user with a 3D image of the surface structure of the underlying surface. Thus, from the 3D image, the user may extract information regarding not only the position and extension of said line, but also information regarding the position (vertical level) of the existing road pavement relative to the position (vertical level) of the underlying surface, and information regarding the contour/slope between the existing road pavement and the underlying surface.

Information regarding the difference in position of the existing road pavement relative to the position of the underlying surface may be used to determine the height/thickness of the existing road pavement. The height/thickness value may be used to estimate the amount of new road pavement (pavement material), which is to be laid, so that the height/thickness of the new and the existing road pavement are similar to prevent an uneven road pavement.

Information regarding the contour/slope may be used to determine the required degree of overlap between the existing and the new road pavement. Thus, in case the slope is steep (steep gradient), a lower degree of overlap may be required relative to a case, where the slope is less steep. Said information may also be used to estimate the quality of said slope and of the edge defined by the upper part of said slope, i.e. the edge defined by the part of the existing road pavement which has been compressed by the road paving machine.

In an embodiment, the sensor device can furthermore comprise an emitting unit.

In an embodiment, the emitting unit can comprise at least one optical part.

The emitting and detecting unit may both be directed towards the underlying surface on which the road paving machine is moving. Providing an emitting unit together with the detecting unit has the advantage that the intensity of the emission from the underlying surface may be increased, which may result in a better sensing of the underlying surface. The emitting unit may be based on, but is not limited to, light, ultrasound, laser or radar. The optical part may be based on, but not limited to, light and laser.

In an embodiment, the emitting unit and the detecting unit can be arranged at an angle relative to each other. Providing the emitting unit and the detecting unit at an angle relative to each other may result in that the detecting unit may detect the largest possible intensity reflected from the underlying surface. The angle may be anything from 0 to 180 degrees, but at angles close to 0 degrees, the emitting and the detecting units may have to be placed close to each other in order for the detecting unit to receive an optimal intensity, whereas at angles close to 180 degrees, the detecting unit may also detect e.g. light, ultrasound, laser or radio waves not being reflected. Detecting signal, which has not been reflected, may not give any information of the structure of the underlying surface, and thus may be considered as noise to the detecting unit. Thus, advantageously, the detecting unit only detects what is reflected from the underlying surface.

In an embodiment, the emitting unit can comprise a light source. The light source may e.g. comprise one or more lights such as laser beams or LEDs or electric light bulbs. Other light sources are foreseen within the present invention, as long as they are able to emit a light towards the underlying surface; light which may be reflected. A light source may be advantageous to use as it is reliable, easy to use and requires a relatively low cost.

In an embodiment, the detecting unit can comprise a camera. The camera may be, but is not limited to, a regular optical camera, a stereo camera, or a camera comprising a light source so that the camera may comprise both the emitting and the detecting unit. Applying a camera as detecting unit is advantageous as it is known to be reliable and easy to use.

In an embodiment, the light source can be positioned at an angle relative to the underlying surface, and the camera can be positioned substantially orthogonal to the underlying surface and can be configured to detect light from the light source being reflected from the underlying surface.

Positioning the light source so that it may be configured to emit light towards the underlying surface at an angle may result in that any structure on the underlying surface or line, such as an edge, protrusion, rim or wire arranged on or just above the surface will cast a shadow. The shadow may be used to identifying the existence of and position of the structure.

The camera may be positioned so that it is able to detect the cone of light from the light source on the underlying surface and the shadow cast by any of the structures on the surface as a result of the light source. Thus, the camera may be positioned so that it is able to detect the transition from light to darkness created by the cone of light and the structure or line, such as edge, protrusion, rim or wire arranged on or just above the surface. Thus, the shadow may be used to identify the edge of an existing road pavement of the underlying surface along which a new road pavement is being constructed. The camera may be positioned in the plane of the side plate and may be positioned in front of the side plate and be directed towards the underlying surface so that it forms an image of the cone of light created by the light source, which may comprise the line, such as the edge of the existing road pavement, along which the side plate may be adjusted e.g. with an overlap.

Positioning the camera substantially orthogonal/vertical to the underlying surface and just in front of the side plate, the underlying surface immediately in front of the side plate may be sensed for the presence of the line, and an immediate adjustment of the side plate may be carried out according to the position of the line. Thus, the correction unit comprising the sensor device or at least the camera of the correction unit may be mounted on the side plate such that both the correction unit or at least the camera, and thus the image created by the camera, and the side plate of the screed are moved together, when an adjustment is made of the position of the side plate.

However, the camera may also be positioned with an angle to the underlying surface, but may still detect the cone of light created by the light source on the underlying surface, such that the shadow of the line on the underlying surface may be identified. This way the line may be identified not just in front of, but also or instead a distance ahead of the side plate, so that correction of the side plate may be planned some time before and not only immediately before it is to happen, so that a smooth adjustment of the side plate may be achieved.

In an example, the camera may be positioned 0.5 m above and the light source 0.2 m above the existing road pavement along to which a new strip of road pavement is to be constructed, and the camera and the light source may be arranged with an angle of 45 degrees relative to each other which the inventors have found to be advantageous.

In an embodiment, the light source may emit structured light. The structured light may comprise a pattern of stripes or points, or the light source may emit one or more laser beams comprising a pattern of stripes or points towards the underlying surface. When directing the light source towards the underlying surface comprising a line, which identifies an edge of an existing road pavement of the underlying surface, the pattern may be changed or distorted according to which the position of the line may be derived. The light source may be arranged with an angle or substantially orthogonal/vertical to the underlying surface.

In an embodiment, the sensor device may comprise a device for measuring the distance to the underlying surface, such as a device emitting ultrasound, a laser or a radar. By measuring the time difference between when the respective signal (ultrasound, laser beam or radio wave) is emitted until it is detected after being reflected at the underlying surface comprising the line, the position of the line may be determined.

In an embodiment, the correction unit can further comprise a means for detecting a change in the position of the camera relative to the side plate of the screed. If by accident, the camera experiences a collision with another object, the camera may unintendedly change position relative to the side plate of the screed. Thus, an error may take place in the identification which the sensor device performs of the displacement of the side plate relative to the line. Thus, advantageously, the correction unit may comprise a means for detecting a change in the position of the camera relative to the position of the side plate. Said means may be a spirit level.

In an embodiment, the correction unit can further comprise at least one adjustment means adapted to adjust the position of at least part of the correction unit relative to the position of the side plate of the screed. Said means may be a mounting part for mounting the correction unit on the side plate of the screed, or for mounting at least the camera and the light source of the correction unit, or for mounting at least the camera of the correction unit on the side plate of the screed. The mounting part may be adapted to adjust the height of the correction unit relative to the side plate as not all side plates of screeds have the same height.

The mounting part may be adapted to adjust the distance at which the correction unit is positioned in front of the side plate (relative to the direction of movement of the road paving machine) as the size of the side plate at the vertically lower end may vary which may affect the image detected by the detecting unit, e.g. by the camera.

The mounting part may be adapted to adjust how much the new strip of pavement is to overlap the existing strip of road pavement along which the new strip of road pavement is to be constructed. The correction unit and/or the mounting part may comprise a scale adapted to adjust the size of the overlap. The reference of the scale may be in line with the inner side surface of the side plate of the screed. The scale may be plus or minus 2 inches relative to the reference, but may also be larger if necessary. The overlap and thus the position of the correction unit may thus be adjusted with a high degree of precision and be locked in the wanted position. The scale may be adjusted manually or automatically.

In an embodiment, the sensor device can be further adapted to sense at least part of said underlying surface comprising the edge of the existing road pavement and therefrom identify the thickness of the existing road pavement and provide a sensing signal for controlling the amount of pavement material to be added.

Providing information regarding the thickness of the existing road pavement may be advantageous in that the amount of new road pavement (pavement material), which is to be laid, may be estimated so that the height/thickness of the new and of the existing road pavement are similar. This facilitates an even road pavement of a high quality.

The sensor device may sense the underlying surface by providing an optical image of the underlying surface by use of an optical device such as a 2D or a 3D camera or may sense the underlying surface by use of a laser scanner, laser or a radar.

In case the sensor device makes use of a 2D camera, the edge may be identified by providing a shadow cast by the edge. The shadow may be provided by e.g. a light source directing a cone of light at the edge at an angle relative to a vertical axis of the edge. Thus, the camera may be positioned so that it is able to detect the transition from light to darkness created by the cone of light and the edge. The size and shape of the shadow may be used to obtain information regarding the height of the existing road pavement as the width of the shadow may characterise said height of the existing road pavement. This means that the wider the shadow is, the higher the existing road pavement will be.

In case the sensor device makes use of a 3D camera, information extracted from the 3D image regarding the difference in position (vertical level) of the existing road pavement relative to the position (vertical level) of the underlying surface may be used to determine the height/thickness of the existing road pavement. The height/thickness value may be used to estimate the amount of new road pavement (pavement material), which is to be laid, so that the height/thickness of the new and the existing road pavement are similar to prevent an uneven road pavement.

In case the sensor device makes use of a laser scanner, laser or radar, information regarding the positions (vertical levels) of the existing road pavement and of the underlying surface, respectively, may be extracted by e.g. determining the distance from the sensor device to said existing road pavement and underlying surface. The information may be analysed to determine the height of said existing road pavement.

Thus, a correction unit may be provided for determining the amount of road pavement material to be added by a road paving machine for moving along an underlying surface while adding a strip of pavement material to said underlying surface, where the correction unit comprises a sensor device which is adapted to sense at least part of said underlying surface comprising an edge of an existing road pavement and therefrom identify the thickness of the existing road pavement and provide a sensing signal for controlling the amount of pavement material to be added.

In accordance with the invention, there is further provided a screed for laying a road pavement, the screed comprising a correction unit for correcting the position of a side plate of the screed of a road paving machine for constructing a road pavement relative to a line on an underlying surface on which the road paving machine is adapted to move, where the correction unit comprises a sensor device, where the sensor device is adapted to sense at least part of said underlying surface comprising the line and therefrom identify a displacement of the side plate of the screed of the road paving machine relative to the line on the underlying surface and provide a sensing signal for controlling the position of the side plate.

In accordance with the invention, there is further provided a road paving machine for constructing a road pavement, the road paving machine comprising a towing machine adapted to move on an underlying surface, a screed for laying a road pavement, and a correction unit for correcting the position of a side plate of the screed of the road paving machine for constructing a road pavement relative to a line on an underlying surface on which the road paving machine is adapted to move, where the correction unit comprises a sensor device, where the sensor device is adapted to sense at least part of said underlying surface comprising the line and therefrom identify a displacement of the side plate of the screed of the road paving machine relative to the line on the underlying surface and provide a sensing signal for controlling the position of the side plate.

It is understood that the term line may be understood as anything identifying a direction along which a new strip of road pavement is to be constructed. The line may comprise any part of the edge of an existing strip of road pavement or of a foundation on or along which the new strip of road pavement is to be constructed, or of a curb. The line may also be a wire along which a new strip of road pavement is to be constructed, e.g. a wire positioned on a planar surface, or a wire identifying an edge along which the new strip of road pavement is to be constructed, where the wire may be arranged directly above or next to said edge.

The structure and function of the correction unit and the method of using it will be described in more detail below with references to exemplary embodiments shown in the drawings wherein, FIGS. 1*a* and 1 *b* show an embodiment of the correction unit in combination with a screed of a road paving machine, seen from above and in front of the screed, respectively.

Figure 2:
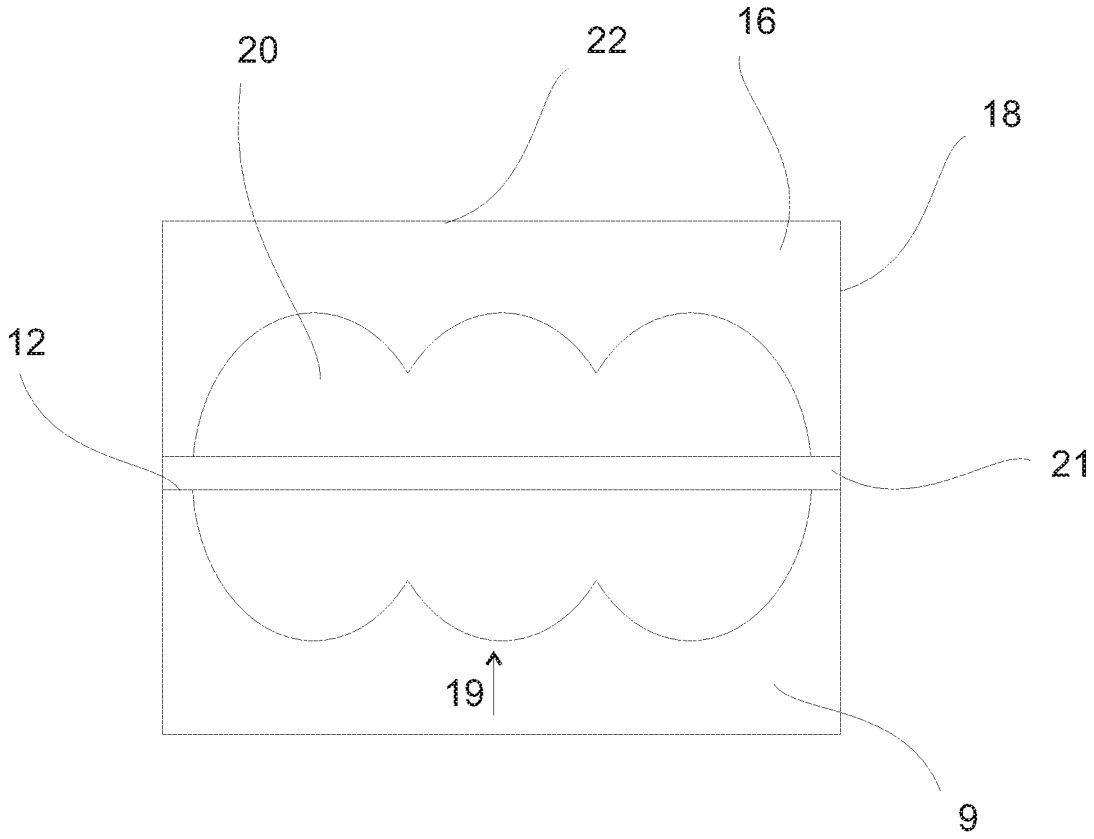

FIG. 2 shows an embodiment of an image, made by the camera of the correction unit, of the underlying surface of the road paving machine.

Figure 3A:
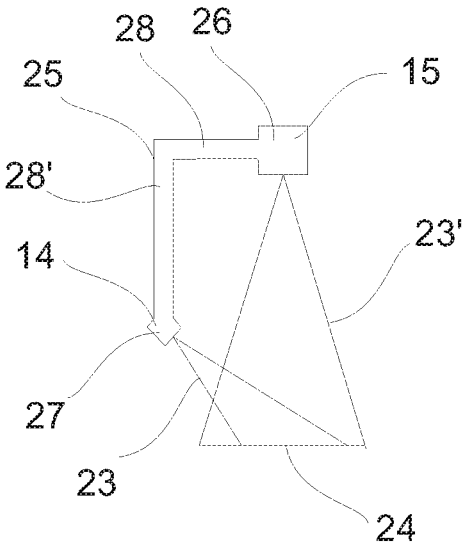
Figure 3B:
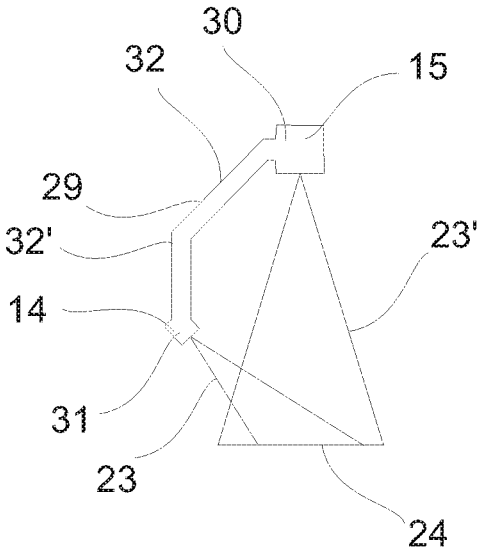
Figure 3C:
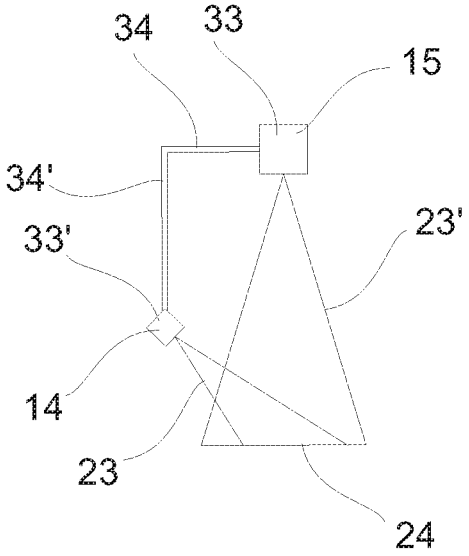

FIGS. 3*a*, 3*b* and 3*c* show three embodiments of the emitting unit connected to the detecting unit.

Figure 4A:
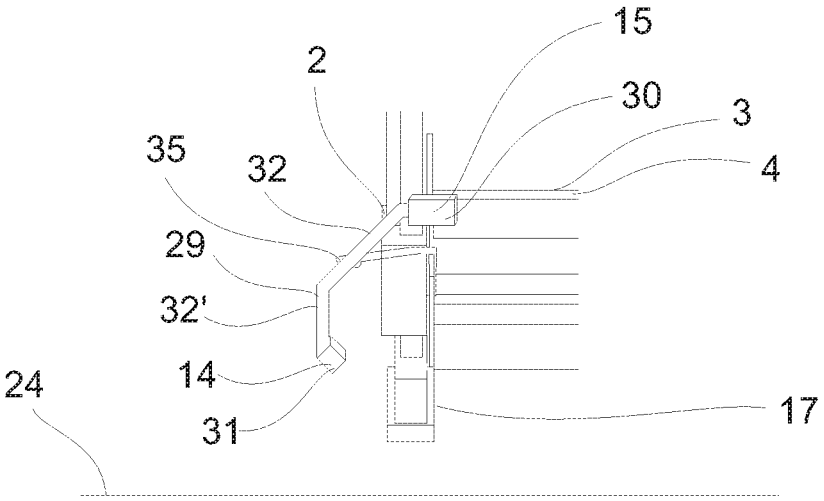
Figure 4B:
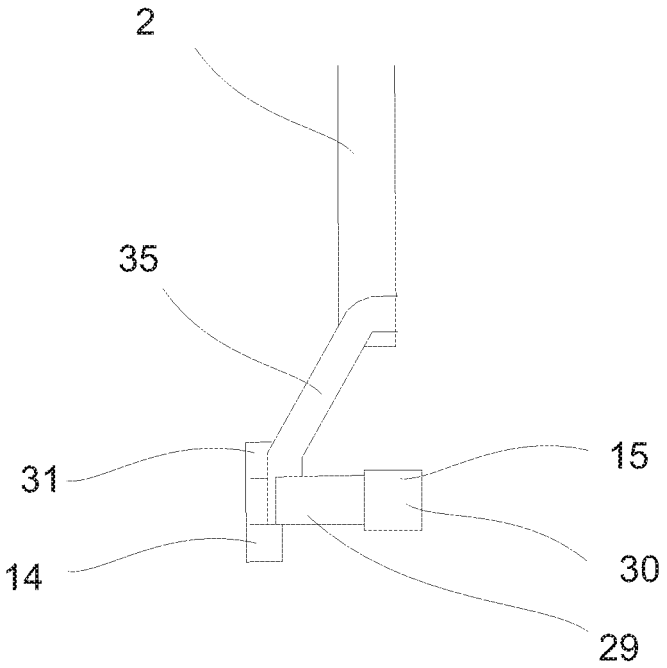

FIGS. 4*a* and 4*b* show two embodiments of the correction unit connected to the screed of a road paving machine, seen from in front of and above the screed, respectively.

In the figures the correction unit is inter alia shown having a six-sided shape with a four-sided cross section and the connection part comprising two straight elements arranged with an angle to each other. However, it should be understood that other cross-sections, such as circular, triangular, many-sided . . . are also intended within the scope of the present invention.

In the figures, embodiments, which show the connection to one type of screed, are illustrated. The person skilled in the art will understand that the illustrated combinations of correction unit and screeds and road paving machines are not to be understood as exhaustive and that the correction unit may be mounted on various kinds of screeds and road paving machines.

FIGS. 1*a* and 1 *b* show an embodiment of the correction unit in combination with a screed of a road paving machine, seen from above and in front, respectively, of the screed relative to the direction of movement of the road paving machine.

In FIG. 1*a*, the road paving machine 1 is seen from above. Only the side plates 2, 2' and part of the basis part 3 of the screed 4 of the road paving machine 1 are shown for clarity.

The side plate 2 of the screed 4 may be moved substantially orthogonal to the driving direction 5 of the road paving machine 1. The movement of the side plate 2 of the screed 4 is indicated by the arrows 6*a* and 6*b*. However, it is foreseen within the present invention that the side plate 2 may also move with an angle relative to the driving direction 5 of the road paving machine 1.

In front of the basis part 3 of the screed, the road pavement material 7, such as asphalt, is being placed. The road pavement material 7 is being distributed by the screed 4, i.e. by the basis part 3 and the side plates 2,2' of the screed 4, across the area 8 defined by said basis part 3 and the side plates 2,2' of the screed 4 as the road pavement material 7 comes into contact with the basis part 3 of the screed 4.

The road paving machine 1 may be moving along an already existing strip of road pavement 9 and at the same time construct a new strip of road pavement 10. The new strip of road pavement 10 may be constructed with an overlap 11 to the existing strip of road pavement 9, such that the density and quality of the new strip of road pavement 10 may be maximised at the overlap 11.

The edge 12 of an existing strip of road pavement 9 may be of various types. Thus, the edge 12 may be of butt joint (paver construction), butt joint (milled or cutback) or notched wedge joint, where butt joint may comprise a vertical or sharp angle or be undefined, and the notched wedge joint may comprise a sharp angle relative to the underlying surface.

The size of the overlap 11 may vary inter alia depending on the type of the edge 12 and on the way in which the existing 9 and new strip of road pavement 10 are constructed. For example, the existing 9 and new strip of road pavement 10 may be constructed simultaneously or with a time interval in between so that the existing strip of road pavement 9 may have cooled for both butt joint or notched wedge joint types of edges, in which case the size of the overlap 11 may be 3-4 mm, 1-1.5 inches, or 0.5-1 inches, respectively. However, within the present invention it is understood, that there may also be an overlap of 0 mm. Thus, the side plates 2, 2' may be adapted to be adjusted to at least these distances.

The correction unit 13 may comprise a sensor device (not shown) comprising an emitting unit 14, comprising an optical part such as a light source 14 as illustrated in FIG. 1*a*, and a detecting unit 15, such as a camera as illustrated in FIG. 1*a*. Both light source 14 and camera 15 may be positioned in front of the side plate 2 of the screed 4 so that said side plate 2 does not affect the view of the camera 15. The light source 14 may emit light at the underlying surface of the road paving machine 1 which may comprise the existing strip of road pavement 9 and the surface 16 on which the new strip of road pavement 10 is to be constructed. The light source 14 may comprise one or more LEDs. The dimension of the light source 14 may be 45 mm×50 mm×200 mm. However, other dimensions depending inter alia on the number of lights are foreseen within the present invention.

In FIG. 1*a*, the cones of light of the light source 14 may be directed at the edge 12 of the existing road pavement 10 and at the existing strip of road pavement 9 and surface 16 on which the new strip of road pavement 10 is to be constructed adjacent to the edge 12. The camera 15 may be positioned just in front of the side plate 2 of the screed 4 and thus be positioned in the plane of the side plate 2. The camera 15 may be arranged vertically with a precision of +1-5 degrees in relation to the underlying surface and viewing the underlying surface.

The camera 14 may comprise a resolution of 1280×1024 pixel, with an angle of view of 17 degrees. The dimensions of the camera may be 100 mm×100 mm×60 mm. However, other dimensions are foreseen within the present invention. The precision of the correction unit 13 may be +/−6 mm, or may be +/−1-3 mm, or may even be +/−1 mm.

Within the present invention, it is foreseen that both side plates 2,2' may comprise a correction unit 13.

Figure 1B:
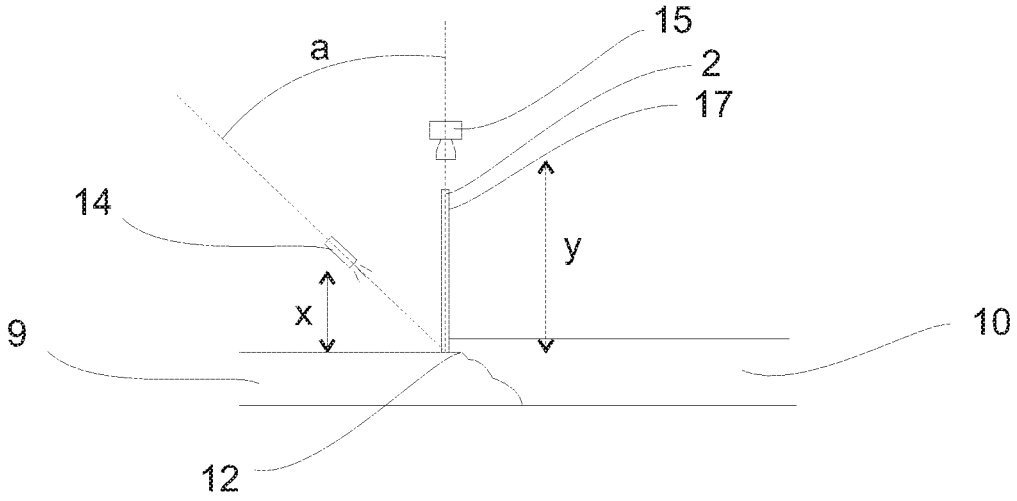

In FIG. 1*b*, the road paving machine 1 is seen from the front relative to the driving direction of the road paving machine 1. For similar feature as shown in FIG. 1*a*, similar reference numbers have been applied.

In the embodiment of FIG. 1*b*, it is shown that the light source 14 may be positioned near the outer side of the side plate 2 of the screed 4 and in the embodiment of FIG. 1*b*, the light source 14 is positioned over the existing strip of road pavement 9 and thus may be overlapping the existing strip of road pavement 9 with a larger distance than the side plate 2 of the screed 4 and the camera 15. Furthermore, it is shown that the light source 14 may be positioned with an angle to the underlying surface and emit light towards the edge 12 of the existing strip of road pavement 9.

The camera 15 may be positioned in front of the side plate 2 of the screed 4 and insect the plane of the side plate 2 of the screed 4. The camera 15 may be positioned vertically. Thus, the camera 15 may be positioned so that it may make an image of the cone of light made by the light source 14 and of the edge 12 of the existing strip of road pavement 9. The camera may be positioned so that the middle of the camera view and thus of the image made by the camera 14 is aligned with the plane of the inner surface 17 of the side plate 2 of the screed 4. However, the camera 14 may be shifted relative to the plane of the inner surface 17 of the side plate 2 of the screed 4 depending on the wanted size of the overlap 11.

The light source 14 may be positioned with a height x, and the camera 15 may be positioned with a height y above the surface of the existing strip of road pavement 9. The height x may be 0.2 m and the height y may be 0.5 m. The light source 14 may be arranged with an angle a relative to the camera 15. The angle a may be 45 degrees.

The correction unit 13 may comprise a device for indicating the view of the camera 15 on the underlying surface, such as a laser pointer.

The correction unit 13 may furthermore comprise a device for logging e.g. the images made by the camera 15, or the size of the overlap 11.

FIG. 2 shows an embodiment of an image 18, made by the camera 15 of the correction unit 13, of the underlying surface of the road paving machine 1. For similar features as in the previous Figs., similar reference numbers have been used.

In the embodiment of FIG. 2, the existing strip of road pavement 9 and the surface 16 on which the new strip of road pavement 10 is to be constructed is illustrated. The light source 14 is shown as emitting light in the direction indicated by the arrow 19. The light source 14 is shown as comprising three lights, where the cone of lights 20 of each of the three lights is directed at the edge 12 of the existing strip of road pavement 9. As the existing strip of road pavement 9 may be positioned vertically above the surface 16 on which the new strip of road pavement 10 is to be constructed and as the light source 14 may emit light at an angle, a shadow 21 is cast going from the edge 12 of the existing strip of road pavement 9 towards the surface 16 on which the new strip of road pavement 10 is to be constructed. The width of the shadow 21 may depend on the difference in heights of said existing strip 9 and said surface 16 and on the angle between the light source 14 and the existing strip of road pavement 9. The width of the shadow 21 may be analysed for determining the thickness of the existing strip of road pavement 9.

On the basis of the position of the edge 12 of the existing strip of road pavement 9 relative to a reference, such as the middle of the image 18 or a reference point or line on the image 18 or a previously produced image 18 of the underlying surface, the displacement of the side plate 2 of the screed 4 of the road paving machine 1 relative to the line 12 on the underlying surface may be identified, and the sensor device may provide a sensing signal for controlling the position of the side plate 2.

The sensor device may be connected to a control unit (not shown) adapted to receive the sensing signal from the sensor device and to adjust the position of the side plate 2 of the screed 4 of the road paving machine 1 relative to the edge 12 of the existing strip of road pavement 9 based on the sensing signal for controlling the position of the side plate 2 according to the predetermined overlap 11.

The correction unit 13 may be adapted to control the quality of the image made by the camera 15 so as to control that the image 18 is sufficiently good for identifying the edge 12 of the existing strip of road pavement 9.

The quality control may be adapted to identify whether the cone of light(s) 20 in the centre of the image 18 is/are brighter than at the borders 22 of the image 18. If this is not the case, the edge 12, or line 12 identified on the image 18, may have been cast by another light source.

The quality control may be adapted to identify if sufficient contrast exists between light and shadow 21 on the image 18. If no sharp contrast exists, the sensor device may not identify the edge 12 of the existing strip of road pavement 9, or the correction unit 13 may be positioned too close to the underlying surface, or no edge 12 of the existing strip of the road pavement 9 may be present.

The quality control may be adapted to divide the image 18 into two or more smaller areas and may be adapted to analyse each area separately. The edge 12 of the existing strip of the road pavement 9 may be identified in each area and the position of said edge 12 may be compared. In case said edge 12 is not identified approximately at the same position in the separate areas, and thus being approximately coherent, said edge 12 may not have been identified.

The correction unit 13 may comprise a means for ensuring that the camera 14 is directed at the cone(s) of light at the underlying surface. The means may be a means for measuring the distance to the underlying surface, such as a laser, or a means for identifying where the cone(s) of light is/are positioned, such as a device for measuring light or an IR indicator.

FIGS. 3*a*, 3*b* and 3*c* show three embodiments of the emitting unit 14 connected to the detecting unit 15. For similar features as shown in the previous Figs., similar reference numbers have been applied.

In the embodiment of FIGS. 3*a*, 3*b* and 3*c*, the emitting unit 14 may be a light source 14, and the detecting unit 15 may be a camera 15. The camera 15 and the light source 14 may be positioned at a distance from each other and may as such be arranged in the same house or may be arranged in separate houses. The light source 14 is illustrated as emitting a light 23 at an underlying surface 24, and the camera 15 is illustrated as detecting light 23' emitted from the underlying surface 24.

In the embodiment of FIG. 3*a*, the light source 14 and the camera 15 may be arranged in the same house 25. The house 25 may comprise a first end 26 comprising the camera 15 and a second end 27 comprising the light source 14. The first 26 and second end 27 may be connected by two straight parts 28, 28' being substantially orthogonal to each other.

In the embodiment of FIG. 3*b*, the light source 14 and the camera 15 may be arranged in the same house 29. The house 29 may comprise a first end 30 comprising the camera 15 and a second end 31 comprising the light source 14. The first 30 and second end 31 may be connected by two straight parts 32, 32' being arranged with an angle to each other. Said angle may be larger than 90 degrees and smaller than 180 degrees.

In the embodiment of FIG. 3*c*, the light source 14 and the camera 15 may be arranged in separate houses 33, 33'. A first house 33 may comprise the camera 15, and a second house 33' may comprise the light source 14. The first 33 and second house 33' may be connected by two straight parts 34, 34' being substantially orthogonal to each other.

FIGS. 4*a* and 4*b* show two embodiments of the correction unit 13 connected to the side plate 2 of the screed 4 of a road paving machine 1, seen from in front of and above the screed 4, respectively. For similar features, similar reference numbers have been used as in the previous Figs.

In FIG. 4*a*, the correction unit 13 comprising the sensor device is shown as comprising a camera 15 positioned so that its centre is aligned with the inner surface 17 of the side plate 2 of the screed 4 and oriented towards the underlying surface 24 of the road paving machine 1. The light source 14 is shown as being positioned beside the side plate 2 of the screed 4, being oriented towards the underlying surface 24 with an angle relative to said underlying surface 24.

The camera 15 and the light source 14 may be arranged in the same house 29 comprising a first end 30 comprising the camera 15 and a second end 31 comprising the light source 14. The first 30 and second end 31 may be connected by to straight parts 32,32' being arranged with an angle to each other.

The correction unit 13 may be mounted on the side plate 2 of the screed 4 by means of a mounting part 35. The mounting part 35 may be fixed to said side plate 2 and to at least one of the straight parts 32,32' of the house 29. The mounting part 35 may ensure that the correction unit 13 is positioned in a correct manner relative to the side plate 2 of the screed 4.

The mounting part 35 may be adapted to adjust the height of the correction unit 13 relative to the side plate 2 as not all side plates 2,2' have the same height.

The mounting part 35 may be adapted to adjust the distance at which the correction unit 13 is positioned in front of the side plate 2 (relative to the direction of movement of the road paving machine 1) as the size of the side plate 2 at the vertically lower end may vary which may affect the image 18 detected by the camera 15.

The mounting part 35 may be adapted to adjust how much a new strip of road pavement 10 is to overlap an existing strip of road pavement 9 along which the new strip of road pavement 10 is to be constructed. The correction unit 13 and/or the mounting part 35 may comprise a scale adapted to adjust the size of the overlap 11. The reference of the scale may be in line with the inner side surface 17 of the side plate 2 of the screed 4. The scale may be plus or minus 2 inches relative to the reference, but may also be larger if necessary. The overlap 11 and thus the position of the correction unit 13 may thus be adjusted with a high degree of precision and be locked in the wanted position. The scale may be adjusted manually or automatically.

In FIG. 4*b*, the correction unit 13 connected to the side plate 2 of the screed 4 of a road paving machine 1 is seen from above.

The correction unit 13 comprising the camera 15, the light source 14 and the house 29 is shown as being positioned by the mounting part 35 in front of the side plate 2 of the screed 4. The centre of the camera 15 is shown as being aligned with the plane P of the inner surface 17 of the side plate 2 of the screed 4.

The line 12 may be based on a foundation or a curb, or the line 12 may be a wire.

In case said line 12 is based on a foundation and the new strip of road pavement 10 is to be placed on and inside the edge of the foundation, the correction unit 13 may follow the edge of the foundation. In such case, the correction unit 13 may be turned around so that the light source 14 (or emitting unit) is positioned in front of, but between the side plates 2,2' of the screed 4, with an angle to the underlying surface 24. Thus, the light source 14 emits light from a higher lying foundation to the lower lying surrounding surface.

In case said line 12 is based on a curb, the new strip of road pavement 10 is to be placed along the curb without an overlap. Thus, the correction unit 13 may identify the position of the edge of the curb and therefrom identify a displacement of the side plate 2 of the screed 4 of the road paving machine 1 relative to the edge of the curb, and provide a sensing signal for controlling the position of the side plate 2 to be substantially aligned with said edge of the curb.

The line 12 may be wire, in case a new strip of road pavement 10 is to be constructed on e.g. a foundation as the first strip of road pavement on the foundation, which ensures a straight and precisely constructed strip of road pavement. To ensure focus of the camera on the wire, the height of the camera 14 relative to the side plate 2 of the screed 4 or the focus to the camera 14 may be adjusted.

Thus, the line 12 may be a wire along which a new strip of road pavement 10 is to be constructed, e.g. a wire positioned on a planar surface without following e.g. an edge, or the line 12 may be a wire identifying an edge along which the new strip of road pavement 10 is to be constructed, where the wire may be arranged directly above or next to said edge.

Modifications and combinations of the above principles and designs are foreseen within the scope of the present invention.

The invention claimed is:

1. A screed of a road paving machine for moving along an underlying surface while adding a strip of pavement material to said underlying surface, wherein a position of a side plate of the screed determines a position of an edge of the strip of road pavement material added, the screed comprising:

a correction unit for correcting the position of said side plate, said correction unit comprising a sensor device;

wherein the sensor device is adapted to capture an at least two-dimensional image of at least part of said underlying surface comprising an edge of an existing road pavement, said image identifying a line or edge along which a new strip of road pavement is to be constructed, and said image containing at least two-dimensional information about the position of the line or edge in a moving direction of said road paving machine, and therefrom identify a displacement of the side plate of the screed of the road paving machine relative to the line or edge of said existing road pavement and provide a sensing signal for controlling the position of the side plate;

wherein the line or edge is defined by an upper part of a slope or contour between the existing road pavement and the underlying surface; and wherein a control unit receives the sensing signal from the sensor device and utilizes the sensing signal to control the position of the side plate.

2. A road paving machine for moving along an underlying surface while adding a strip of pavement material to said underlying surface, wherein a position of a side plate of a screed of the road paving machine determines a position of an edge of the strip of road pavement material added, the road paving machine comprising:

a towing machine adapted to move on the underlying surface, a screed comprising at least one side plate, and a correction unit for correcting the position of said side plate, said correction unit comprising a sensor device, wherein the sensor device is adapted to capture an at least two-dimensional image of at least part of said underlying surface comprising an edge of an existing road pavement, said image identifying a line or edge along which a new strip of road pavement is to be constructed, and said image containing at least two-dimensional information about the position of the line or edge in a moving direction of said road paving machine, and therefrom identify a displacement of the side plate of the screed of the road paving machine relative to the line or edge of said existing road pavement, and provide a sensing signal for controlling the position of the side plate, and wherein the line or edge is defined by an upper part of a slope or contour between the existing road pavement and the underlying surface; and wherein a control unit receives the sensing signal from the sensor device and utilizes the sensing signal to control the position of the side plate.

3. A correction unit for correcting a position of a side plate of a screed of a road paving machine for moving along an underlying surface while adding a strip of pavement material to said underlying surface, wherein the position of the side plate determines a position of an edge of the strip of road pavement material added, said correction unit comprising:

a sensor device adapted to capture an at least two-dimensional image of at least part of said underlying surface comprising an edge of an existing road pavement, said image identifying a line or edge along which a new strip of road pavement is to be constructed, said image containing at least two-dimensional information about an extension of the line or edge in a moving direction of said road paving machine along said underlying surface, wherein, based on said captured image containing at least two-dimensional information about the extension of the line or edge along said underlying surface, the correction unit is configured to identify a displacement of the side plate of the screed of the road paving machine relative to the line or edge of said existing road pavement and provide a sensing signal for controlling the position of the side plate, wherein the line or edge is defined by an upper part of a slope or contour between the existing road pavement and the underlying surface, and wherein a control unit receives the sensing signal from the sensor device and utilizes the sensing signal to control the position of the side plate.

4. The correction unit of claim 3, wherein the correction unit comprises the control unit that receives the sensing signal from the sensor device and the control unit is adapted to adjust the position of said side plate relative to the edge based on the sensing signal for controlling the position of the side plate.

5. The correction unit of claim 3, wherein:

a light source directs light at the line or edge at an angle relative to a vertical axis of the line or edge;

a shadow is cast by the line or edge based on the light; and the line or edge is identified, at least in part, by identifying the shadow.

6. The correction unit of claim 5, wherein a width of the shadow is utilized to obtain information indicating a height of the existing road pavement.

7. The correction unit of claim 3, wherein the sensor device comprises a detecting unit.

8. The correction unit of claim 7, wherein the sensor device comprises an emitting unit.

9. The correction unit of claim 7, wherein the detecting unit comprises at least one optical part.

10. The correction unit of claim 8, wherein the emitting unit and the detecting unit are arranged at an angle relative to each other.

11. The correction unit of claim 8, wherein the emitting unit comprises a light source.

12. The correction unit of claim 11, wherein the detecting unit comprises a camera.

13. The correction unit of claim 12, wherein the light source is positioned at an angle relative to the underlying surface, and the camera is positioned substantially orthogonal to the underlying surface and configured to detect light from the light source being reflected from the underlying surface.

14. The correction unit of claim 13, wherein the correction unit is further configured to detect a change in the position of the camera relative to the side plate of the screed.

15. The correction unit of claim 3, wherein the correction unit is further configured to adjust the position of at least part of the correction unit relative to the position of the side plate of the screed.

16. The correction unit of claim 3, wherein the sensor device is further adapted to sense at least part of said underlying surface comprising the edge of the existing road pavement and therefrom identify a thickness of the existing road pavement and provide a sensing signal for controlling an amount of pavement material to be added.

* * * * *